US007380318B2

(12) United States Patent
Wada et al.

(10) Patent No.: US 7,380,318 B2
(45) Date of Patent: Jun. 3, 2008

(54) METHOD OF MANUFACTURING LIQUID DISCHARGE HEAD

(75) Inventors: Takatsugu Wada, Kanagawa (JP); Masatake Akaike, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 480 days.

(21) Appl. No.: 10/985,928

(22) Filed: Nov. 12, 2004

(65) Prior Publication Data

US 2005/0104939 A1 May 19, 2005

(30) Foreign Application Priority Data

Nov. 13, 2003 (JP) ..... 2003-383272
Dec. 3, 2003 (JP) ..... 2003-403921

(51) Int. Cl.
*B21D 53/76* (2006.01)
*H04R 17/10* (2006.01)

(52) U.S. Cl. ..... 29/25.35; 29/890.1; 29/846; 438/21; 347/68; 347/71

(58) Field of Classification Search ..... 29/890.1, 29/25.35, 846, 831; 347/68, 70, 71, 72; 438/21, 438/455, 459
See application file for complete search history.

(56) References Cited

U.S. PATENT DOCUMENTS 5,439,843 A * 8/1995 Sakaguchi et al. ..... 438/459
5,874,975 A * 2/1999 Hotomi et al. ..... 347/70
6,109,737 A * 8/2000 Kishima ..... 347/70
6,402,303 B1 * 6/2002 Sumi ..... 347/68

FOREIGN PATENT DOCUMENTS

JP 5-286132 * 11/1993 ..... 29/890.1
JP 6-290983 10/1994
JP 7-246705 9/1995
JP 11-220185 8/1999
JP 2000-52550 2/2000
JP 2000-141644 5/2000

OTHER PUBLICATIONS

Smith, W. F., "Principles of Materials Science and Engineering", 1986, McGraw-Hill Book Co., pp. 580-584.*

* cited by examiner

*Primary Examiner*—A. Dexter Tugbang
(74) *Attorney, Agent, or Firm*—Fitzpatrick, Cella, Harper & Scinto

(57) ABSTRACT

In a method of manufacturing a liquid discharge head, liquid in a pressure generation chamber is pressurized by a piezoelectric driving force of a piezoelectric element, and is discharged from a nozzle communicated with the pressure generation chamber. The method is characterized by the steps of providing a flow passage substrate incorporating the pressure generation chamber, anodically joining a diaphragm to the flow passage substrate, forming electrode layers and a piezoelectric film of the piezoelectric element on the diaphragm, and crystallizing the piezoelectric film during or after the lamination at a crystallization temperature not higher than a strain point of the diaphragm.

9 Claims, 9 Drawing Sheets

METHOD OF MANUFACTURING LIQUID DISCHARGE HEAD

BACKGROUND OF THE INVENTION

1. Field of the Invention

The present invention relates to a liquid discharge head incorporating a unimorph type piezoelectric element using a piezoelectric thin film (piezoelectric film) and a method of manufacturing thereof, and also a method of manufacturing a piezoelectric element. The present invention can apply to any of various devices using a driving force of a piezoelectric element, including a liquid discharge head incorporated in a recording apparatus such as a printer.

2. Description of the Related Art

These years, the studies of devices using functional thin films have been prosperous, and it has been expected to materialize excellent functions by forming a functional material into a thin-film which is incorporated in any of various devices.

For example, studies of devices including piezoelectric elements, sensors, nonvolatile memories and the like, using physical properties such as piezoelectricity, pyroelectricity, polarization reversal have been prosperous. Among others, recording apparatuses of liquid discharge type in which liquid such as ink is discharged by a piezoelectric driving force have been rapidly developed since it can record an image having a highly precise and fine quality and a high density at a high speed, and since it can be appropriate for color printing, and compact so as to be applied in not only printers but also copiers, facsimiles and the like. In such a technical field of recording, there has been increased such a demand that the recording technology enhances the recording quality and the degree of recording accuracy in future. As one of various ways for materializing the demand, a piezoelectric element utilizing a piezoelectric thin film (piezoelectric film) is used, and is expected to be applied in a high quality and high precise recording technology for the next generation.

There can be enumerated various methods of manufacturing piezoelectric films. For example, Japanese Patent Laid-Open No. H06-290983 discloses a film forming method for a PZT film, using RF sputtering. Further, Japanese Patent Laid-Open No. H11-220185 discloses a method of forming a PZT film oriented in (100) plane under control of precursor decomposing temperature in a sol-gel process.

There can be enumerated various types of piezoelectric element utilizing a piezoelectric film. Among others, a unimorph type piezoelectric element in which a diaphragm having a Young's modulus different from that of a piezoelectric material, is laminated thereover with a piezoelectric film is extremely excellent, and accordingly, it can be simply applied to a liquid discharge head.

As one of the liquid discharge heads using the unimorph type piezoelectric element as a drive source, there may be exemplified the one having such a configuration that a glass substrate (glass diaphragm) which is anodically joined to an Si substrate as a passage substrate is transferred thereonto with a piezoelectric film deposited on another substrate. Since the glass substrate serves as an excellent diaphragm, and has a linear expansion coefficient which is nearly equal to that of the Si substrate, it is appropriate to anodically join the glass substrate onto the Si substrate in order to form a unimorph type piezoelectric element.

Almost functional thin films are oxides, and in particular, a thin film having piezoelectricity is in general a composite oxide, and accordingly, the crystallization thereof requires a high temperature. For example, a high temperature of not less than about 1,000° C. is required for crystallization of a bulk body of a piezoelectric material, and further, a high temperature of substantially 800 to 900° C. is required for crystallization of even a thin film with the use of annealing in, for example, a sol-gel process. Accordingly, for the crystallization, there has been used such a method that a thin film is deposited on an additional substrate with no heat, and after the deposition of the film, the film is annealed, or a method that an additional substrate is heated for crystallization while a piezoelectric film is deposited. However, since the crystallization requires a high temperature, a single crystal substrate which can resist the high temperature is required for the additional substrate on which a piezoelectric film is deposited. There may be enumerated, as typical one, MgO, $SrTiO_3$ and the like, which are extremely expensive in general. Thus, it is relatively disadvantageous to use these materials for the additional substrate which is consumed away by one time of film deposition.

In addition, in the case of deposition of a piezoelectric film on a single crystal substrate, since only the single crystal substrate should be removed by melting with hot phosphoric acid or the like after it is bonded to a glass substrate serving as a diaphragm, and since this melting requires a very long time, it is extremely disadvantageous in view of not only the costs but also the throughput thereof, resulting in a great barrier against the mass-production thereof.

In order to solve the above-mentioned problems, it is effective to use a method of depositing a piezoelectric film on a glass substrate serving as a diaphragm, direct thereto. For example, Japanese Patent Laid-Open No. H07-246705 discloses a method of depositing a PZT film, direct onto SiN sputtered onto an Si substrate through the intermediary of a zirconia film as a lead diffusion preventing layer. However, the linear expansion coefficient of SiN is extremely small in comparison with that of Si, and accordingly, the PZT film is susceptible to peel off from the Si substrate during a heat-treatment process, that is, it is disadvantages in view its process. Further, even though the heat-treatment can be completed without peel-off, it is thereafter required to etch the rear surface of the Si substrate in order to form flow passages including a pressure generation chamber, and further to be mated with a liquid supply system for ink or the like, which has been separately formed. In this case, a loss is possibly caused during bonding between the finely processed articles, and accordingly, there would be caused a risk of lowering the yield thereof. That is, it is difficult to enhance the yield since the Si substrate cannot be processed beforehand.

Further, Japanese Laid-Open Patent No. H07-246705 discloses a method in which a glass substrate incorporating ITO electrodes and serving as a diaphragm is anodically joined to a head base formed therein with flow passages, and screen printing of PZT octylate chloride is calcined and crystallized at a temperature of 500° C. However, the diaphragm has a thickness of not less than several tens of micron meter so as to be able to be handled, and accordingly, the joint part of the diaphragm is directly subjected to affection of thermal strain caused by a difference in thermal expansion during heat-treatment for crystallization. Thus, there is a risk of lowering the joint strength during the heat treatment, and further, it is difficult to completely crystallize the PZT base at a temperature of 500° C.

Further, Japanese Patent Laid-Open No. H05-286132 discloses a method in which a glass ceramic substrate serving as a diaphragm is anodially joined to a head base formed therein with flow passages, and screen printing of a PTZ paste is calcined and crystallized at a temperature of 1,000° C. In this case, since the diaphragm also requires a thickness of not less than several tens of micron meter so as to be able to be handled, and in addition, since the joint part of the diaphragm is susceptible to thermal strain caused by a difference in thermal expansion, the joint strength is deteriorated, and further, the glass ceramic substrate can hardly resist against a thigh temperature of 1,000° C. for crystallization of the PZT. Further, it cannot be assured to prevent the joint part of the diaphragm by anodic joint from peeling off at a high temperature up to 1,000° C.

By the way, such a method that a piezoelectric film is directly deposited on a heat resistant diaphragm without using a transfer process is also effective. As to the method in which the piezoelectric film is directly deposited on the heat resistant diaphragm, as disclosed in Japanese Laid-Open Patent No. 2000-52550, there is a method in which the surface of an Si substrate is thermally oxidized so as to form an $SiO_2$ layer, and it is used as a diaphragm.

However, in the case of such a technique that a piezoelectric film is formed on a diaphragm with no use of a transfer process, there may be enumerated the following points to be improved: In the configuration disclosed in Japanese Patent Laid-Open No. 2000-52550, a PZT film is directly deposited on an $SiO_2$ layer formed on an Si substrate, and is then crystallized, and thereafter, the Si substrate is cut out by etching, at a surface on the side remote from the PTZ film, so as to form flow passages including a pressure generation chamber. In such a manufacturing method, when the PZT film is cooled after it is crystallized at a high temperature, the lattice constant thereof is greatly changed being affected by a thermal expansion coefficient of the Si substrate serving as a film deposition substrate, and accordingly, the piezoelectricity of the PZT film is greatly deteriorated. Although the reason why this phenomenon is caused cannot completely be clarified, there may be considered the following points:

Although the thermal expansion coefficient of the PTZ film varies, depending upon its composition, around an MPB composition (Zr:Ti=0.53:0.47) having a highest piezoelectricity, it is about $9\times10^{-6}$ (/° C.). Meanwhile, the thermal expansion coefficient of the Si substrate is $3\times10^{-6}$ (/° C.) which is relatively lower than that of the PZT film. Thus, when the PZT film is cooled to a room temperature by way of a Curie point after it is crystallized, the PZT film greatly contracts, but the degree of contraction of the Si substrate is small, and accordingly, the PZT film is subjected to a large force in a tensioning direction. In order to relax this force, the orientation of the PZT crystal which is tetragonal is mostly directed in the in-plane direction of the Si substrate in which C-axis having a long crystalline axis is subjected to a tension force. Since the polarizing axis of the PZT film which is tetragonal is in the C-axial direction, the crystalline in which the polarizing direction is vertical, that is, the so-called 90 degree domain, is dominative, with respect to the vertical direction of the substrate plane to which an electric field is applied. Thus, it may be considered that the piezoelectricity is possibly deteriorated by a large degree.

Meanwhile, Japanese Patent Laid-Open No. 2000-141644 discloses such a configuration that an intermediate film is provided for applying tensile stress to a PZT film which is formed on an Si substrate formed thereon with a $SiO_2$ layer serving as a diaphragm. The reason why the intermediate film is provided is such as to prevent occurrence of such a risk that since the thermal expansion coefficient of the PZT film is greater than that of the $SiO_2$ layer, when flow passages including a pressure generation chamber is formed on the side remote from the PZT film which is a piezoelectric film, the $SiO_2$ diaphragm having a thin thickness of several micron meters, is subjected to a force in the direction of compression due to a difference in thermal expansion with respect to the PZT film, and accordingly, it is deformed toward the liquid flow passage. However, in this method, the 90 deg. domain which does not contribute to the piezoelectricity of the PZT film, tends to contrarily increase, and accordingly, the piezoelectricity is remarkably deteriorated.

Further, Japanese Patent Laid-Open No. H07-246705 discloses a method in which a PZT film is deposited on an SiN layer sputtered on an Si substrate and serving as a diaphragm, through the intermediary of a zirconia film for preventing diffusion of lead. Since the thermal expansion coefficient of the zirconia film is greater than that of the PZT film, the provision of such a film between the diaphragm and the piezoelectric film is effective for decreasing tensile stress to the piezoelectric film even though its purpose is different more or less. However, since the stress is the product of a Young modulus and a degree of strain, a stress caused by heat hysteresis is proportional to a product of the thermal expansion coefficient of its material and its Young modulus. Accordingly, Since the lengths with which the films make contact with each other are equal to each other among the areas, the film thickness is problematic, and accordingly, if a specific relationship cannot not satisfied, the tensile stress applied to the PZT film cannot be reduced.

SUMMARY OF THE INVENTION

The present invention is devised in view of the problems which are inherent to the above-mentioned technology and which has not yet been solved. In a typical embodiment of the present invention, a specified glass material having an excellent characteristic so as to be used as a diaphragm, and having a high heat resistance and a linear expansion coefficient which is nearly equal to that of an Si substrate, is anodically joined to the Si substrate (flow passage substrate) which has been finely processed beforehand, then the glass diaphragm is thinned by polishing so as to have a thickness not greater than 10 μm so as to have a slight flexion in a pressure generation chamber, and thereafter electrode layers and a piezoelectric film are directly deposited on the thinned glass diaphragm, thereby it is possible to prevent occurrence of deformation and peel-of of the piezoelectric film caused by thermal strain of the glass diaphragm during deposition and crystallization of the piezoelectric film. Thus, an object of the present invention is to provide a liquid discharge head which can greatly contribute to the enhancement of the reliability of the discharge performance and the cost reduction of a liquid discharge type recording apparatuses or the like, and is to provide also a method manufacturing thereof.

According to the present invention, there is provided a method of manufacturing a liquid discharge head which pressurizes liquid in a pressure generation chamber by a piezoelectric driving force of a piezoelectric element, and then discharges the liquid from a nozzle communicated with the pressure generation chamber, characterized by the steps of:

providing a flow passage substrate incorporating therein the pressure generation chamber, anodically joining a diaphragm to the flow passage substrate, forming an electrode layers and a piezoelectric film of the piezoelectric element on the diaphragm; and crystallizing the piezoelectric film at a temperature lower than a transition point of the diaphragm during or after the lamination thereof.

It is preferable to crystallize the piezoelectric film at a temperature not higher than a strain point of the diaphragm.

The transition point is a temperature where the diaphragm is in a state of glass lower than the temperature and properties, for example, volume or thermal expansion, of the diaphragm greatly vary not lower than the temperature. The strain point is a temperature where strain does not occurs not higher than the temperature.

It is preferable to provide a step of thinning the glass diaphragm by polishing so that the glass diaphragm have a thickness of not greater than 10 μm after the joining step and before the forming step.

According to the present invention, there is provided a method of manufacturing a piezoelectric element, said method comprising the steps of:

providing a diaphragm made of glass including Na;

forming electrode layers and a piezoelectric film of the piezoelectric element on the diaphragm; and crystallizing the piezoelectric film during or after the formation at a temperature lower than a transition point of the diaphragm.

Although almost glass materials have in general a low strain point, those including aluminosilicate glass have a strain point not less than a temperature of 650° C. are present. These glass materials contain therein Na which enables the glass diaphragm to be anodically joined, and further, have a linear expansion coefficient nearly equal to that of Si so as to prevent deterioration of a firm joint between an Si substrate used as the flow passage substrate and the glass diaphragm even though the Si substrate and the glass diaphragm which have been anodically joined to each other are heated up to a temperature of about 600 to 700° C.

Meanwhile, since the sintering temperature of a material having piezoelectricity is extremely high, PZT which is representative of piezoelectric materials should be sintered at a temperature of not less than 1,000° C., otherwise it cannot not be completely crystallized, but the applicant has been found such a fact that a PZT thin film deposited under vacuum has a sintering temperature which is greatly lowered, and accordingly, it can be sufficiently crystallized even by sintering (annealing) at a temperature of about 650° C.

Accordingly, as stated above, after the glass diaphragm made of an aluminosilicate glass material having a high strain point is anodically joined to the Si flow passage substrate which has been formed therein with a pressure generation chamber and the like beforehand, the glass diaphragm is thinned by polishing, and then is deposited and laminated, directly thereon with the electrode layers and the piezoelectric film of the piezoelectric element while the crystallization of the piezoelectric film is effected by depositing the same onto the glass diaphragm while the glass diaphragm is heated up to a temperature not lower than the strain point thereof, or by annealing the same at a temperature not lower than the strain point of the glass diaphragm after the deposition of the piezoelectric film. By selecting, for the glass diaphragm, a glass material having a strain point higher than the crystallization temperature of the piezoelectric film, the thermal strain of the glass diaphragm is reduced during the annealing step or the like, thereby it is possible to facilitate the manufacture of a highly reliable liquid discharge head having a unimorph type piezoelectric element as a drive source.

Further, the glass diaphragm is thinned by polishing so as to completely remove parts where the surface is uneven or the characteristic is changed after anodic joint of the glass diaphragm in order to have a smooth surface, and since the glass diaphragm is polished so as to have a thickness of not greater than 10 μm, and the glass diaphragm can be flexed in the pressure generation chamber. With this flexion, a difference in thermal expansion during heat treatment for crystallization is absorbed in order to prevent the anodic joint part of the glass diaphragm from peeling off. The glass diaphragm thinned by polishing uniformly has a surface unevenness of not less than 1 nm, and accordingly, the adherence of the piezoelectric film formed on the glass diaphragm is enhanced, and accordingly, it can hardly peel off during heat treatment.

Further, by directly depositing and forming the piezoelectric film and the like on the glass diaphragm, the material costs can be greatly reduced in comparison with the conventional one which utilizes a single crystal substrate as a consumable article for transferring a PZT film, and since the necessity of the step of melting the single crystal substrate, which is extremely time-consuming can be eliminated, it is possible to greatly enhance the throughput.

Further, the liquid discharge heat according to the present invention preferably satisfies the following relationships:

(Thermal Expansion Coefficient of Intermediate film×Young's Modulus×Thickness)−(Thermal Expansion Coefficient of Glass Diaphragm×Young's Modulus×Thickness)≧(Thermal Expansion Coefficient of Piezoelectric Film×Young's Modulus×Thickness).

In the case of using an Si substrate as the flow passage substrate, unless the diaphragm having a thermal expansion coefficient which is nearly equal to that of Si is used, the probability of the peel-off becomes higher due to thermal hysteresis. Since the Si substrate has a relatively small thermal expansion coefficient of about $3\times10^{-6}$(/° C.), a glass material having a relatively small thermal expansion coefficient should be selected for the diaphragm. Further, in such a case that an $SiO^2$ layer is formed on the Si substrate by oxidizing the surface of the Si substrate, and then the Si substrate is cut out in its rear surface so as to be used as the diaphragm, $SiO_2$ has an extremely small thermal expansion coefficient of $0.2\times10^{-6}$(/° C.), and accordingly, it goes without saying that a diaphragm having a small thermal expansion coefficient is used.

On the contrary, almost piezoelectric materials for forming piezoelectric films have large thermal expansion coefficients, and in particular, typical PTZ having a MPB composition with a highest piezoelectricity has a relatively large thermal expansion coefficient of $9\times10^{-6}$ (/° C.). Accordingly, a piezoelectric film having a high thermal expansion coefficient is deposited on a diaphragm having a low thermal expansion coefficient, and accordingly, the piezoelectric film would be applied with a high tensile stress when it is cooled after it is crystallized.

As an example, FIG. 7 shows an X-ray diffraction pattern which was obtained when a PZT film deposited on a MgO substrate having a sufficiently large thickness was sintered and crystallized. Further, FIG. 8 shows the relationship between the thermal expansion coefficient and the spacing d of PZT (112) (211) mixing peaks, which was obtained by X-ray diffraction when a PZT film deposited on an Si substrate having a sufficiently large thickness was sintered and crystallized. The PTZ film shown in FIG. 7 is non-orientated, and PZT (211) is PZT (112) (211) mixing peak, exactly. In view of this PZT (112) (211) mixing, as shown in FIG. 8, it is understood that the spacing d becomes smaller on the Si substrate having a small thermal expansion coefficient and accordingly tension is caused while the spacing d become larger on the MgO substrate having a thermal expansion coefficient larger than that of PTZ and accordingly compression is caused.

Referring to FIG. 9 which is a view for explaining the cause of deterioration of piezoelectricity, in the case of the deposition on a substrate having a small thermal expansion coefficient, such as an Si substrate, a deposited film is applied thereto with a tensile stress upon phase transition of crystallization when it is cooled from a crystallization temperature down to a room temperature by way of its Curie point, and accordingly, the direction of the C axis, that is, the polarizing axis, is directed in a plane which is orthogonal to the electric field and in which a tensile strain is exerted, within a tetragon such as PTZ, and in other words, the so-called 90 deg. domain becomes dominative. For example, a deposited film which is tetragonal and which has (100) (010) (001) equivalent planes at its crystallization temperature almost has those directed in (100) due to a tension in the plane when it is transferred into the tetragon by way of the Curie point. Thus, since those having polarizing axes which are directed orthogonal to the electric field become dominative, it may be considered that the piezoelectricity is deteriorated.

FIG. 10 shows an electric characteristic in the case of deposition of a PZT film on a MgO substrate having a large thermal expansion coefficient, and FIG. 11 shows an electric characteristic in the case of deposition of a PZT film on an Si substrate having a small thermal expansion coefficient. In comparison between FIG. 10 and FIG. 11, it is understood that, as to the relationship between the electric field and the electric flux density (P-E curve), a satisfactory hysteresis in which the square ratio becomes is high while the saturated electric flux density is high is depicted on the MgO substrate and accordingly, the piezoelectricity becomes highest, but the hysteresis is deteriorated on the Si substrate, that is, the square ratio drops while the saturated electric flux density of low, and accordingly, the piezoelectricity becomes lower.

With the repetitions of eager studies by the applicants, it has been in success to restrain the 90 deg. domain from increasing, with the use of such a design that between a thin diaphragm having a thickness of not greater than 10 μm and a piezoelectric element, an intermediate layer having a thermal expansion coefficient greater than that of the piezoelectric film is interposed, having a film thickness which satisfies the following relationship: (Thermal Expansion Coefficient of Intermediate film×Young's Modulus×Thickness)−(Thermal Expansion Coefficient of Glass Diaphragm×Young's Modulus×Thickness)≧(Thermal Expansion Coefficient of Piezoelectric Film×Young's Modulus×Thickness), and accordingly, the piezoelectric film is exerted thereto with stress in the direction of compression during cooling from its crystallization temperature to a room temperature.

That is, with the provision of the intermediate film having a large thermal expansion coefficient which satisfies the above-mentioned relationship, the piezoelectric film can be formed on the diaphragm, direct thereto with no use of a transfer process without deteriorating the piezoelectricity, thereby it is possible to manufacture an excellent unimorph type piezoelectric element. Further, there can be materialized a high performance but inexpensive liquid discharge head using, as a drive source, a unimorph type piezoelectric element which is manufactured by using the above-mentioned technique.

As stated above, the present invention has the following advantages.

Anodically joining can have a relatively higher joint strength and be easily performed.

Since the piezoelectric film during or after the formation is crystallized at a temperature lower than a transition point of the diaphragm, the joint strength between the diaphragm and the flow passage substrate is not degraded.

If the forming step (laminating step) is performed after the jointing step, the diaphragm can be jointed to the flow passage substrate without strain.

DESCRIPTION OF THE PREFERRED EMBODIMENTS

Figure 1A:
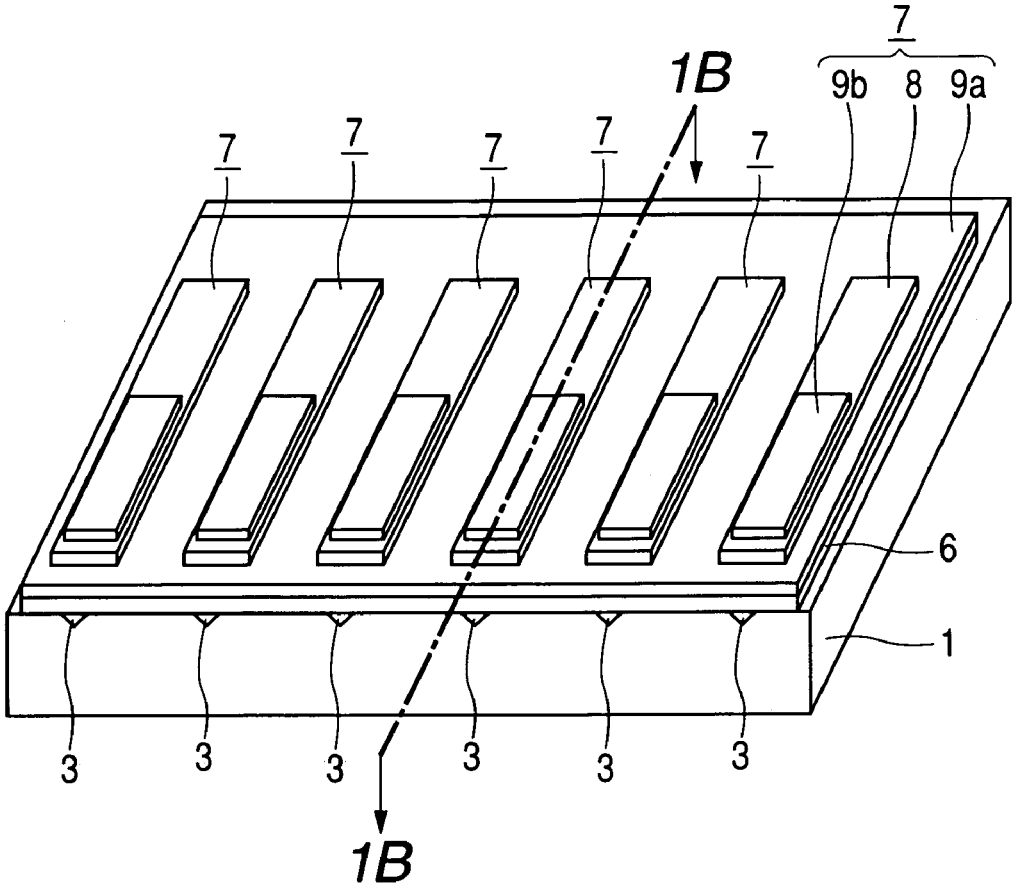
FIG. 1A is a perspective view illustrating a liquid discharge head in an embodiment of the present invention.
Figure 1B:
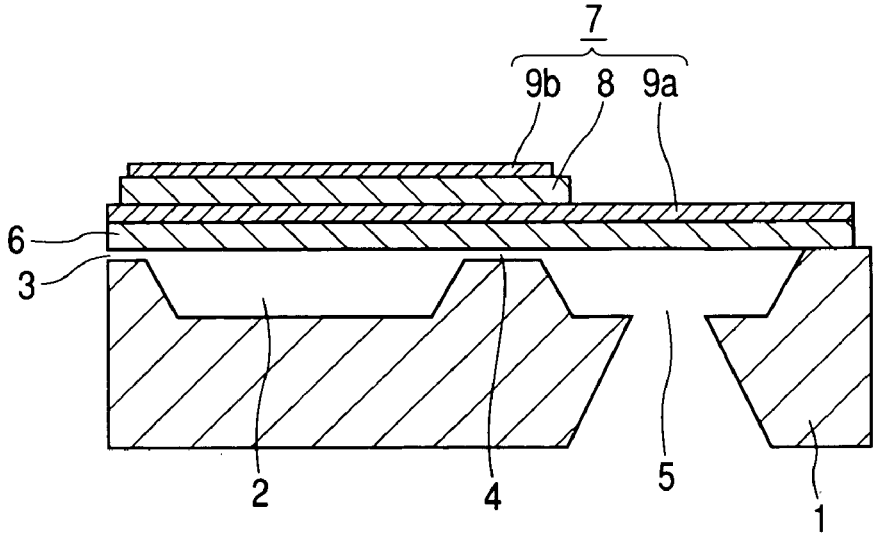
FIG. 1B is a sectional view along line 1B-1B in FIG. 1A.

Referring to FIGS. 1A and 1B, a flow passage substrate 1 has a pressure generation chamber 2, and nozzles 3 communicated therewith, and the pressure generation chamber 2 is communicated with a liquid supply chamber 5 for feeding liquid such as an ink, through an orifice 4. In a liquid discharge head having the flow passage substrate 1 with the pressure generation chamber 2 communicated with the nozzles 3 and a piezoelectric element 7 laminated on a glass diaphragm 6, for applying pressure in the pressure generation chamber 2, the piezoelectric element 7 is a unimorph type piezoelectric element having a piezoelectric film 8 and electrode layers for upper electrodes 9*a*, lower electrodes 9*b* and the like, which are successively deposited and laminated on the glass diaphragm 6, as will be explained later.

The flow passage substrate 1 is an Si substrate, and the glass diaphragm 6 is made of a glass diaphragm material suitably selected from a group consisting of borosilicate glass, aluminosilicate glass and aluminoboroslicate glass.

Further, the piezoelectric film 8 is a thin piezoelectric material film deposited in a depositing process which will be explained later, such as a PZT film which can be sufficiently crystallized even at a temperature not higher than 650° C. Accordingly, the piezoelectric film 8 can be crystallized during or after the deposition thereof without remarkable deformation of the glass diaphragm 6.

Further, the glass diaphragm 6 is mated with the flow passage substrate 1 which is the Si substrate through anodic joint, and is then thinned by polishing so as to have a thickness not greater than 10 μm. With such thinning, the center part of the glass diaphragm 6 corresponding to the pressure generation chamber 2 is flexed by a degree not less than 10 nm, and with the flexion, a difference in thermal expansion between the glass diaphragm 6 and the flow passage substrate 1 during sintering of the piezoelectric film 8 can be absorbed, thereby it is possible to prevent the anodic joint part from being exerted with large thermal strain.

Figure 2A:
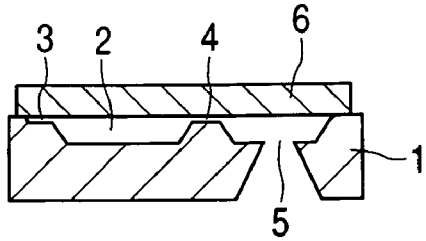
FIGS. 2A, 2B, 2C, 2D, 2E and 2F are sectional views for explaining a method of manufacturing the liquid discharge head shown in FIG. 1A.
Figure 2B:
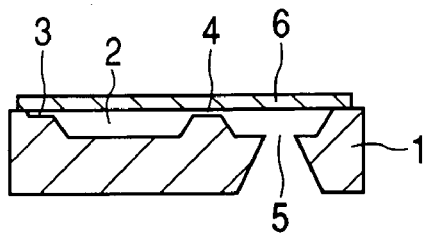
Figure 2C:
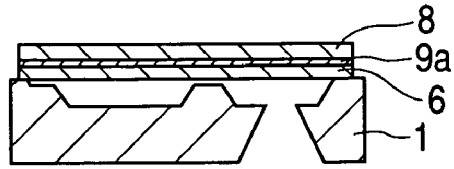

Referring to FIGS. 2A to 2F which are process charts for explaining a method of manufacturing the liquid discharge head shown in FIGS. 1A and 1B, in FIG. 2A, a glass substrate 6*a* which is a glass diaphragm material is anodically joined on the flow passage substrate 1 formed of the Si substrate in which the nozzles 3, the pressure generation chamber 2, the orifice 4 and the liquid supply chamber 5 are formed by a fine process, and in FIG. 2B, the glass substrate 6*a* is thinned by polishing so as to obtain the glass diaphragm 6. Then, as shown in FIG. 2C, the piezoelectric film 8, the upper electrodes 9*a*, the lower electrodes 9*b* and the like are deposited and laminated on the glass diaphragm 6 so as to directly obtain the piezoelectric element 7.

Figure 2D:
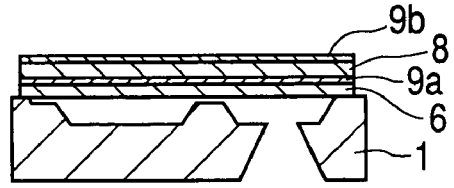
Figure 2E:
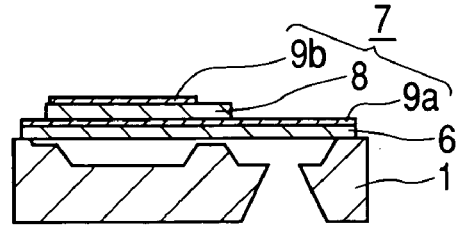
Figure 2F:
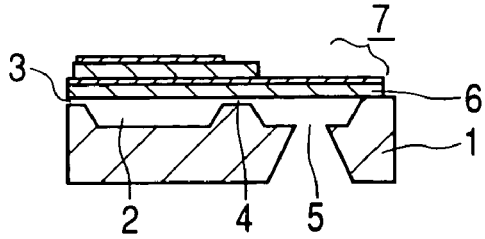

That is, as shown in FIG. 2C, the lower electrodes 9*b* are deposited on the glass diaphragm 6, and then, the piezoelectric film 8 is deposited thereon. The piezoelectric film 8 is crystallized through heat-treatment at a temperature not greater than a transition point, preferably a strain point of the glass diaphragm 6 so as to have piezoelectricity. Then, as shown in FIG. 2D, the upper electrodes 9*a* are deposited on the piezoelectric film 8, and as shown in FIG. 2E, the piezoelectric film 8 and the upper electrodes are patterned. Thereafter, as shown in FIG. 2F, the intermediate parts between the nozzles 3 are cut by a dicing saw, and then the nozzles 3 are opened.

It is noted here that the glass diaphragm 6 (glass substrate 6') is made of a glass material having a high strain point as stated above, which is suitably selected from a group consisting of borosilicate glass, aluminosilicate glass and aluminoborosilicate glass. These glass materials have thermal expansion coefficients which are not less than 50% of that of the Si substrate constituting the flow passage substrate 1 at the above-mentioned heat-treatment temperature, and ions of impurity within the glass serve as mobile ions during the anode joint, and accordingly, it can facilitate the anodic joint.

After the anodic joint of the glass substrate 6*a* is thinned by polishing so as to obtain the glass diaphragm 6 having a thickness not greater than 10 μm after the anode joint, and accordingly, it can be bent by a degree not less than 10 nm in the center part thereof in the pressure generation chamber 2. Simultaneously, the surface of the glass diaphragm 6 is roughened to surface unevenness of not less than 1 nm, thereby it is possible to enhance the adherence to the piezoelectric element 7.

Thus, as a glass material from which the glass diaphragm is formed, among various glass substrates having a low Young's modulus and a high heat resistance, one of borosilicate glass, aluminosilicate glass and aluminoborosilicate glass which have strain points not less than a temperature of 650° C. and thermal expansion coefficients which are nearly equal to that of the Si substrate up to a high temperature, and which can hardly peel off in their joint part, is selected.

Further, as the method of depositing the piezoelectric film 8, there may be used RF sputtering, ion beam sputtering, ion plating, EV evaporation, plasma CVD, MO-CVD, laser aberration and the like.

In particular, in the case of the deposition of a film having a piezoelectricity, the composition greatly contributes to the characteristic thereof, and accordingly, the RF sputtering is preferable since the RF sputtering allows the temperature of the base substrate to be variable and can facilitate the control of the composition under gas pressure.

As the material of the piezoelectric film 8, any of various film materials having piezoelectricity may be used, and those containing therein Pb, Zr and Ti are preferable. There may be represented $Pb(Zr, Ti)O_3$, $(Pb, La)(Zr, Ti)O_3$ or the like. In particular, $Pb(Zr, Ti)O_3$ is more preferable as the material thereof since it is excellent in piezoelectric characteristic.

Embodiment 1

In this embodiment, RF sputtering was used as a method of depositing the piezoelectric film 8, a glass substrate 6*a* from which a glass diaphragm 6 is formed and which is made of aluminosilicate glass SD2 (manufactured by HOYA Co., Ltd) was anodically joined on a flow passage substrate 1 formed of an Si substrate which had been previously formed with a pressure generation chamber 2 and the like, and after being thinned by polishing, a PZT film serving as the piezoelectric film 8 was deposited on the glass diaphragm 6 through the intermediary of a lower electrode without heating, and thereafter, it was sintered for crystallization. The transition point of aluminosilicate glass SD2 (manufactured by HOYA Co., Ltd) 720° C. and the strain point is 670° C.

At first, a groove or the like serving as a nozzle was formed on an Si (100) substrate with the use of an anisotropic etching technology. The groove has a triangular prism-like shape, and further, a pressure generation chamber, an orifice, a liquid supply chamber and the like were formed. Then, an aluminosilicate glass substrate from which a glass diaphragm is formed, having a thickness of 30 μm, was joined to the grooved Si substrate through anodic joint, and the aluminosilicate glass substrate was polished so as to be thinned down to 5 μm. Ti having a thickness of 20 nm, as an adhesive layer, was formed on the thinned glass diaphragm formed of the aluminosilicate glass substrate, and further, Pt having a thickness of 150 nm, which serves as an upper electrode was formed thereon by RF sputtering. Thereafter, a PZT film which is an amorphous piezoelectric film was deposited thereon without heating, up to a thickness of 3 μm at an exhibited Ar gas pressure of 3.0 Pa. This amorphous PZT film can be formed into a PZT film having a piezoelectricity by heat-treatment at a temperature of 650° C.

Figure 3:
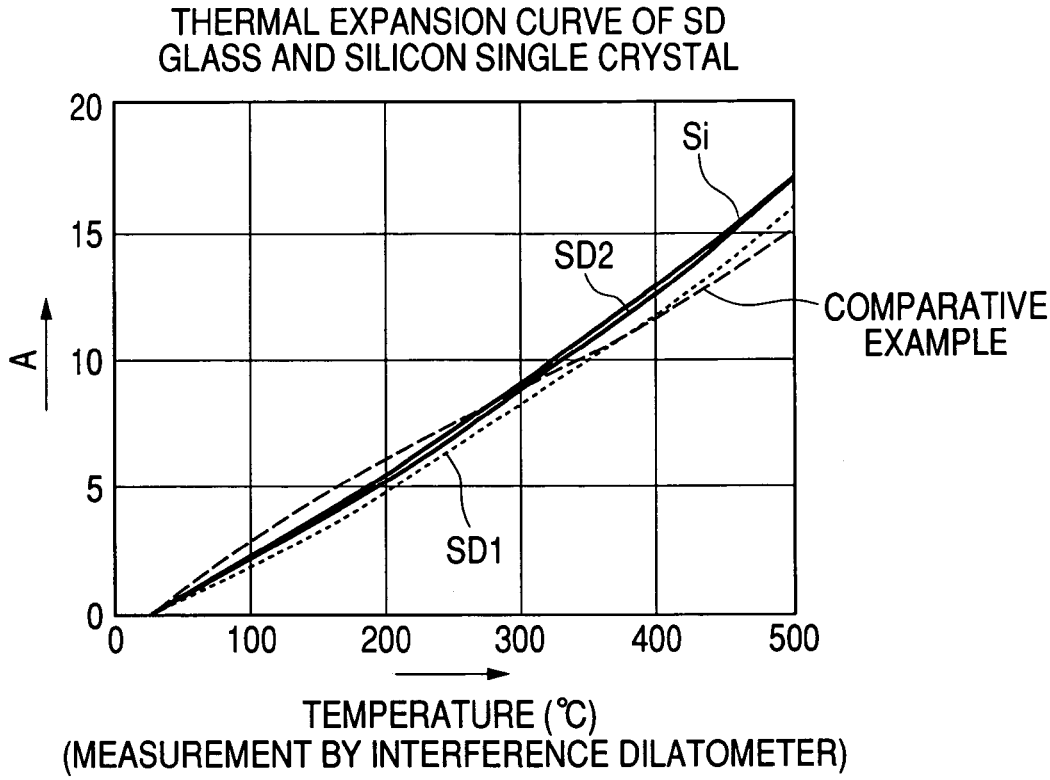
FIG. 3 is a graph which shows variation in thermal expansion of an Si substrate, an aluminosilicate substrate and the like v.s. temperature (extracted from brochures issued by HOYA Co., Ltd.)

The deposited PZT film was annealed for a five hours at a temperature of 650° C. with a rising and falling temperature of 1° C./min under an atmosphere of oxygen so as to be crystallized. The aluminosilicate glass SD2 (manufactured by HOYA Co., Ltd) which constitutes the glass diaphragm, has a strain point of 667° C., and no problems arose even though it was sintered at a temperature of 650° C. Referring to FIG. 3 which shows thermal expansion curves of the Si substrate and the aluminosilicate glass, since the linear thermal expansion coefficients of the Si substrate and the aluminosilicate glass are nearly equal to each other up to a high temperature, no problems of peel-off or the like arose even by sintering. Thereafter, Pt serving as an upper electrode was formed on the surface of the crystallized PZT film by RF sputtering.

It is noted in this embodiment that although there was prepared the liquid discharge head in which the unimorph type piezoelectric element having the upper and lower electrodes formed on the upper and lower surfaces of the piezoelectric film, and having the glass diaphragm joined to its one surface, was formed, various devices each using an unimorph type piezoelectric element may be manufactured by subjecting the Si substrate to various processes.

Figure 4:
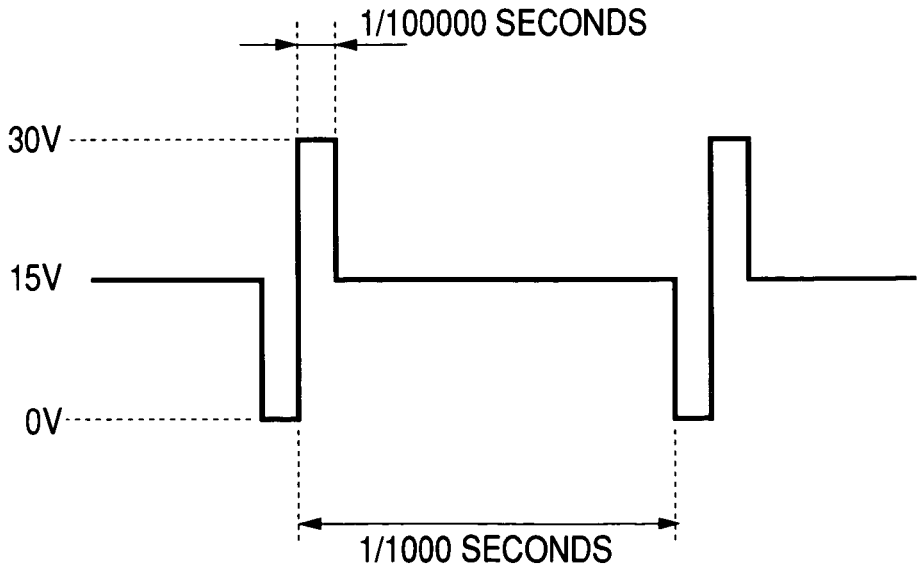
FIG. 4 is a chart illustrating a driving wave which is used for evaluation of a piezoelectric element.

The Pt lower electrode on the PZT film was patterned by dry etching, being aligned with the grooves or the like of the Si substrate, and further, the PZT film was etched along the Pt pattern by wet etching. The thus manufactured unimorph type piezoelectric element was applied thereto with a rectangular wave as shown in FIG. 4 so as to be measured by a laser Doppler displacement meter. It could be confirmed that a unimorph type piezoelectric element having a sufficient displacement could be obtained.

Further, the thus obtained liquid discharge head was filled therein with IPA and was driven by a drive wave as shown in FIG. 4, discharge of droplets could be confirmed.

Embodiment 2

In this embodiment, RF sputtering was used as a method of depositing the piezoelectric film 8, a glass substrate 6*a* from which a glass diaphragm 6 is formed and which is made of aliminosilicate glass SD2 (manufactured by HOYA Co., Ltd) was anodically joined on a flow passage substrate 1 formed of an Si substrate which had been previously formed with a pressure generation chamber 2 and the like, and a PZT film serving as the piezoelectric film 8 of a piezoelectric element 7 was deposited on the glass diaphragm 6 while it was heated for crystallization.

At first, a groove or the like serving as a nozzle was formed on an Si (100) substrate with the use of an anisotropic etching technology. The groove has a triangular prism-like shape, and further, a pressure generation chamber, an orifice, a liquid supply chamber and the like were formed. Then, an aluminosilicate glass substrate from which a glass diaphragm is formed, having a thickness of 30 μm was joined to on the grooved Si substrate through anodic joint, and the aluminosilicate glass substrate was polished so as to be thinned down to 5 μm. Ti having a thickness of 20 nm, as an adhesive layer, was formed on the thinned aluminosilicate glass substrate, and further, Pt having a thickness of 150 nm, which serves as an upper electrode was formed thereon by RF sputtering. Thereafer, a PZT film which is an amorphous piezoelectric film was deposited thereon up to a thickness of 3 μm at an exhibited Ar gas pressure of 3.0 Pa at a base substrate temperature of 650° C.

The aluminosilicate glass SD2 (manufactured by HOYA Co., Ltd), which constitutes the glass diaphragm, has a strain point of 667° C., and no problems arose even though the PZT film was deposited while it was heated at a temperature of 650° C. for crystallization. Referring to FIG. 3 which shows thermal expansion curves of the Si substrate and the aluminosilicate glass, since the linear thermal expansion coefficients of the Si substrate and the aluminosilicate glass are nearly equal to each other up to a high temperature, no problems of peel-off or the like arose even by raising, holding and lowering the temperature up to, at and from a temperature of 650° C. Thereafter, Pt serving as an upper electrode was formed on the surface of the crystallized PZT film by RF sputtering.

The Pt lower electrode on the PZT film was patterned by dry etching, being aligned with the grooves or the like of the Si substrate, and further, the PZT film was etched along the Pt pattern by wet etching. The thus manufactured unimorph type piezoelectric element was applied thereto with a rectangular wave as shown in FIG. 4 so as to be measured by a laser Doppler displacement meter. It could be confirmed that a unimorph type piezoelectric element having a sufficient displacement could be obtained.

Further, the thus obtained liquid discharge head was filled therein with IPA and was driven by a drive wave as shown in FIG. 4, discharge of droplets could be confirmed.

COMPARISON EXAMPLE 1

For comparison, there is exemplified such a liquid discharge head which was manufactured by forming a film having a piezoelectricity through transfer thereof on a diaphragm made of heat resistant glass having a heat resistance which is not so high.

A film was deposited on an MgO substrate by RF sputtering, similar to the embodiment 1 so as to obtain a Pt(111)/Ti/MgO substrate, and a PZT film was deposited thereon by a thickness of 3 μm so as to form a PZT/Pt/Ti/MgO substrate.

The thus formed PZT film was annealed for five hours at a temperature of 700° C. with a rising and falling temperature of 1° C./min under the atmosphere of oxygen. Pt from which an upper electrode is formed was formed by RF sputtering so as to obtain a Pt/PZT/Pt/Ti/MgO substrate.

Heat-resistant glass from which a glass diaphragm is formed and which had been thinned by polishing down to a thickness of 5 μm was joined on the MgO substrate through anodic joint, and an Si substrate formed with grooves or the like, similar to the embodiment 1, was bonded to the MgO substrate on the upper electrode side with the use of an epoxy group adhesive. After the bonding, the substrate was heated at a temperature of 150 d° C. so as to completely cure the epoxy resin, and thereafter, it was moderately cooled. Then, those other than the MgO substrate were protected with resist, and the MgO substrate was resolved by hot phosphoric acid. However, not less than two hours were required for resolving the MgO substrate having a thickness of 300 μm, which was not a level allowed for the throughput on a mass production base. Further, the MgO substrate is extremely expensive, and accordingly, such a fact that it is resolved every time when a piezoelectric element is manufacture is unallowable in view of the costs thereof.

COMPARISON EXAMPLE 2

There is exemplified a liquid discharge head which was obtained by directly forming a piezoelectric film on a heat-resistant glass diaphragm having a heat resistance which is not so high, through deposition.

At first, an Si (100) substrate was formed thereon with grooves or the like serving as a nozzle with the use of anisotropic etching. A liquid supply chamber, an orifice, a pressure generation chamber, a nozzle passage and the like were also formed, a part of the liquid supply chamber piercing. Thereafter, heat resistant glass from which a diaphragm is formed, having a thickness of 30 μm was joined to the Si substrate formed therein with grooves and the like, through anodic joint, and the heat resistant glass was thinned by polishing down to a thickness of 5 μm. Ti as an adhesive layer was formed by a thickness of 20 nm on the heat resistant glass thinned by polishing, and then, Pt from which a lower electrode is formed was formed thereon by FR sputtering, by a thickness of 150 nm. Thereafter, an amorphous PZT film was formed on the surface thereof by a thickness of 3 μm without heating the base substrate, at an exhibited Ar gas pressure of 3.0 Pa. The formed PZT film was annealed for five hours at a temperature of 650° C. with a rising and falling temperature of 1° C./min under an atmosphere of oxygen for crystallization. Since the heat resistant glass has a strain point of 510° C., there has been raised problems in view of the process thereof, such as for example, a problem of serious deformation of the diaphragm from its original shape after annealing.

With the embodiments as stated above, a liquid discharge head or the like, having the unimorph type piezoelectric element serving as a drive unit, is formed as follows: A heat resistant glass substrate from which a glass diaphragm is formed, is anodically joined to the Si substrate which has been formed with flow passages beforehand, and then is thinned by polishing, then an electrode layer made of noble metal or the like, is formed thereon, thereafter, a film having a piezoelectricity being deposited thereon while it is crystallized by heating at a temperature not higher than a strain point of the glass diaphragm, or being deposited with no heating, and is then annealed at a temperature not higher than a strain point of the glass diaphragm for crystallization. Further, the piezoelectric film is formed on the glass diaphragm, direct thereto, and then, an electrode layer made of noble metal is formed on the piezoelectric film. Thus, in comparison with a conventional example in which an expensive single crystal substrate is used as an additional substrate for transferring a piezoelectric element, the liquid discharge head having the unimorph type piezoelectric element allows the material costs to be lowered greatly. Further, since the necessity of the step of resolving a single crystal substrate in a long time can be eliminated, it is possible to expect to enhance the throughput thereof. Further, since the glass diaphragm is joined to the Si substrate which has been formed with the nozzle, the pressure generation chamber and the like beforehand, and since the piezoelectric film is then directly deposited thereon, a liquid discharge head with a higher degree of precision can be manufactured with a satisfactory yield.

Figure 5A:
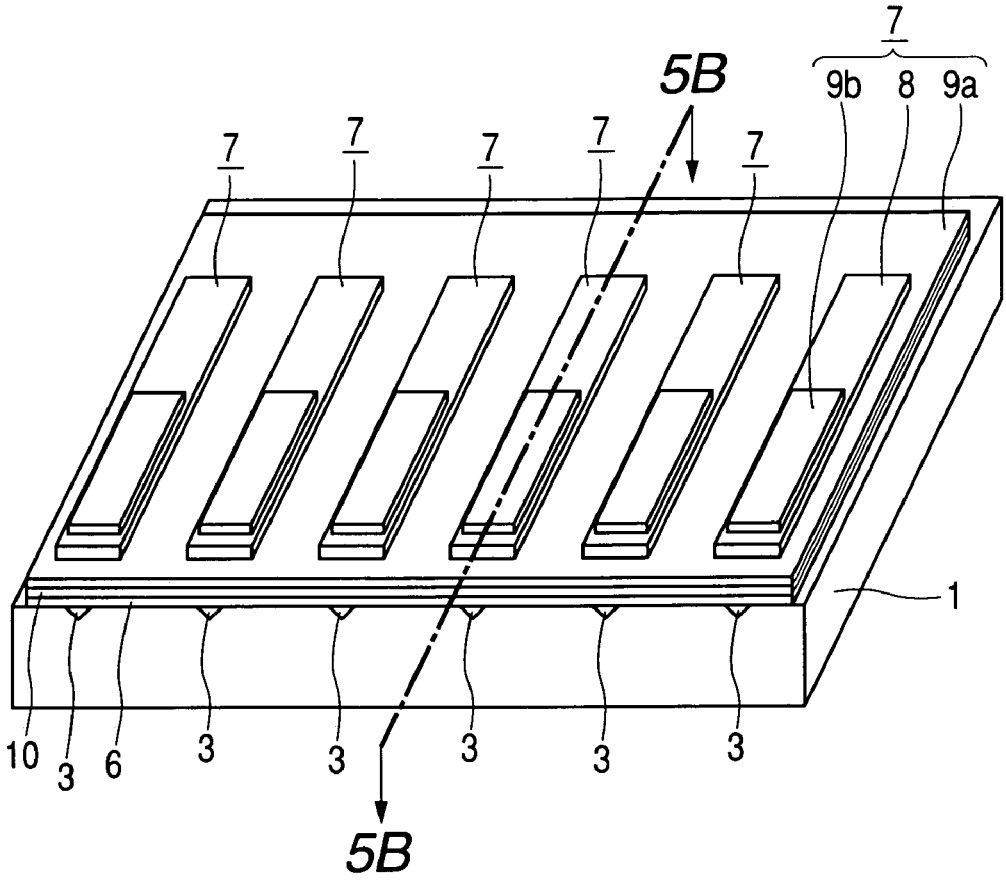
FIG. 5A is a perspective view illustrating a liquid discharge head in an embodiment of the present invention.
Figure 5B:
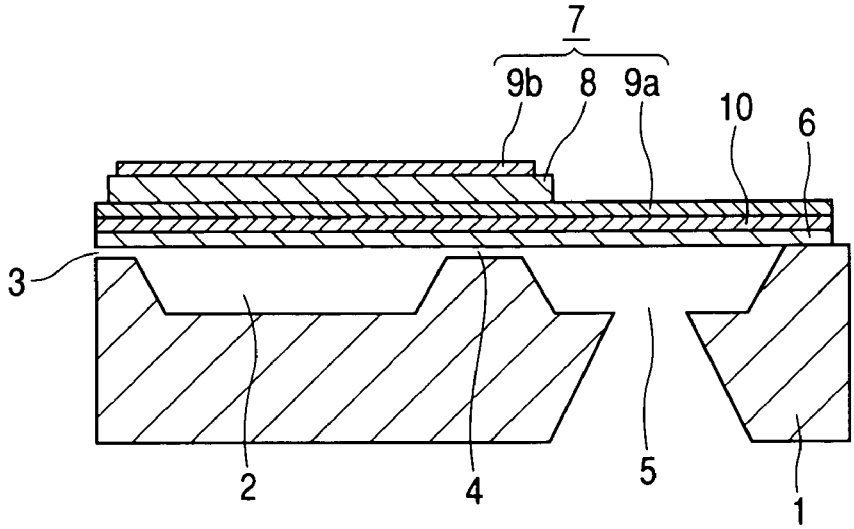
FIG. 5B is a sectional view along line 5B-5B in FIG. 5A.

Referring to FIGS. 5A and 5B which shows a liquid discharge head in an embodiment of the present invention, a flow passage substrate 1 formed of an Si substrate is grooved so as to form therein flow passages such as a pressure chamber 2, nozzles 3, an orifice 4 and a liquid chamber 5, and a diaphragm 6 is anodically joined thereon, and is then thinned by polishing. Further, a piezoelectric film 8 constituting a unimorph type piezoelectric element 7 and first and second electrodes 9*a*, 9*b* serving electrode means are laminated so as to form an piezoelectric actuator.

An intermediate film 10 having a thermal expansion coefficient larger than that of the piezoelectric film 8 is formed being interposed between the piezoelectric element 7 and the diaphragm 6, and then, the piezoelectric film 8 is laminated thereon through the intermediary of a first electrode 9*a* made of noble metal and serving as both atom diffusion preventing means and electrode, and the second electrode 9*b* is formed. It is noted that the thickness of the intermediate film 10 is set so as to satisfy the following conditions:

(Thermal Expansion Coefficient of Intermediate film×Young's Modulus×Thickness)−(Thermal Expansion Coefficient of Glass Diaphragm×Young's Modulus×Thickness)≧(Thermal Expansion Coefficient of Piezoelectric Film×Young's Modulus×Thickness).

The diaphragm 6 can be made of any one of various materials, but among others, a glass pane having a low Young's modulus and a high heat resistance is preferably used. In particular, a glass substrate made of borosilicate glass, aluminosilicate glass or aluminoborosilicate glass, which have a thermal expansion coefficients which are nearly equal to that of the Si substrate up to a high temperature, is preferable.

Various processes can be used as a method of manufacturing a piezoelectric film which is a dielectric thin film having a piezoelectric characteristic. For example, RF sputtering, ion beam sputtering, ion plating, EB evaporation, plasma CVD, MO-CVD, laser aberration and the like are enumerated. Although any one of the deposition processes can form a thin oxide film, since a composition of the piezoelectric film greatly contributes to the characteristic thereof, the RF sputtering which can change the temperature of a substrate and can facilitate the control of the composition under gas pressure is preferably used for the manufacture of the piezoelectric film.

Various thin film materials can be used as a material of the piezoelectric film, and in particular, oxides having a perovskite structure and containing Pb is desirable. For example, $Pb(Zr, Ti)O_3$, $(Pb, La)(Zr, Ti)O_3$ can be represented thereof. In particular, $Pb(Zr, Ti)O_3$ (which is referred to as the so-called PZT) is excellent in piezoelectric characteristic, and therefore is preferable as the material. Further, $Pb(Zn, Nb)O_3$—$PbTiO_3$ solid solution (which is referred to as the so-called PZN—PT) or $Pb(Mg, Nb)O_3$—$PbTiO_3$ solid solution (which is referred to as the so-called PMN-PT) or the like, which have been publicly noticeable, has an extremely large piezoelectric characteristic greater than that of PZT, and accordingly, is preferable as the material As the intermediate film having a thermal expansion coefficient larger than that of the piezoelectric film, any one of various films having large thermal expansion coefficients can be used, and in particular, MgO having a thermal expansion coefficient of $13.0\times10^{-6}$ (/° C.), $ZrO_2$ having a thermal expansion coefficient of $11.5\times10^{-6}$ (/° C.) or Cu having a thermal expansion coefficient of $16.8\times10^{-6}$ (/° C.) which has a large thermal expansion coefficient, and which is excellent in heat resistance, is preferable as the material of the intermediate film.

Embodiment 3

Figure 6A:
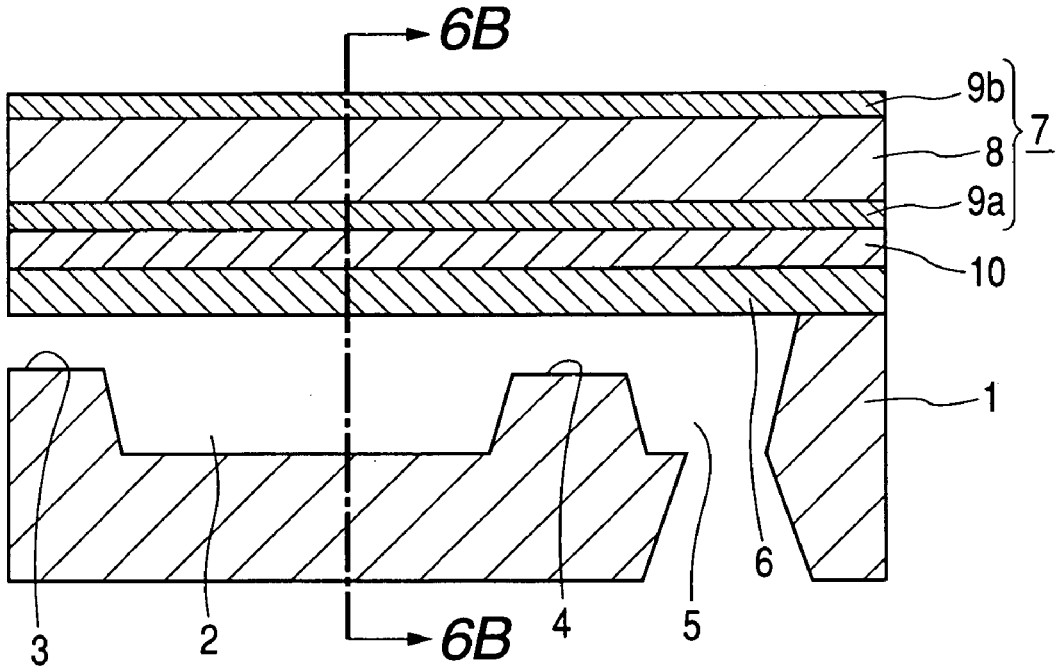
FIG. 6A is a schematic sectional view illustrating a piezoelectric actuator in a third embodiment of the present invention.
Figure 6B:
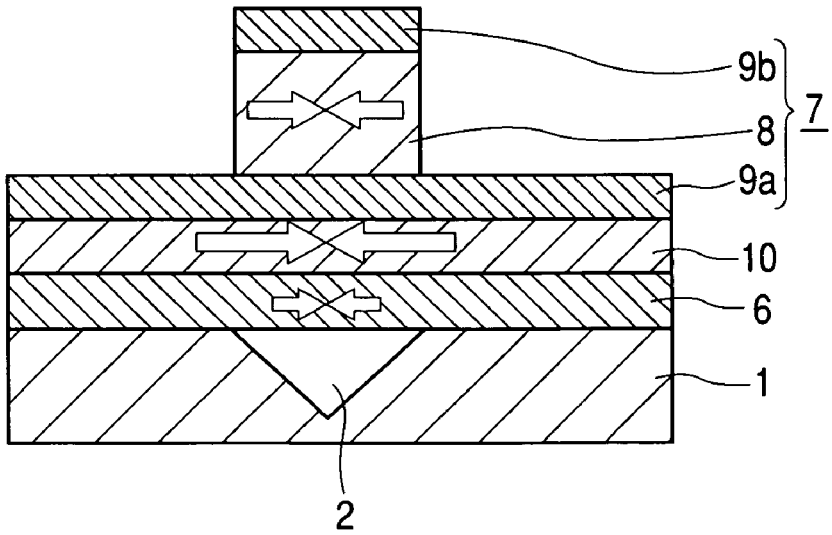
FIG. 6B is a sectional view along line 6B-6B in FIG. 6A.
Figure 7:
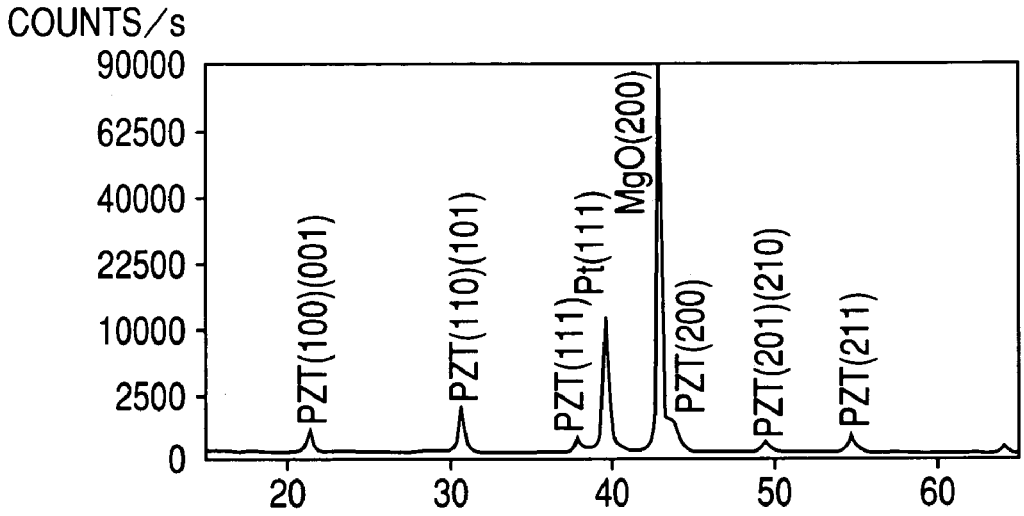
FIG. 7 is a view which shows an X-ray diffraction pattern of a PZT film.
Figure 8:
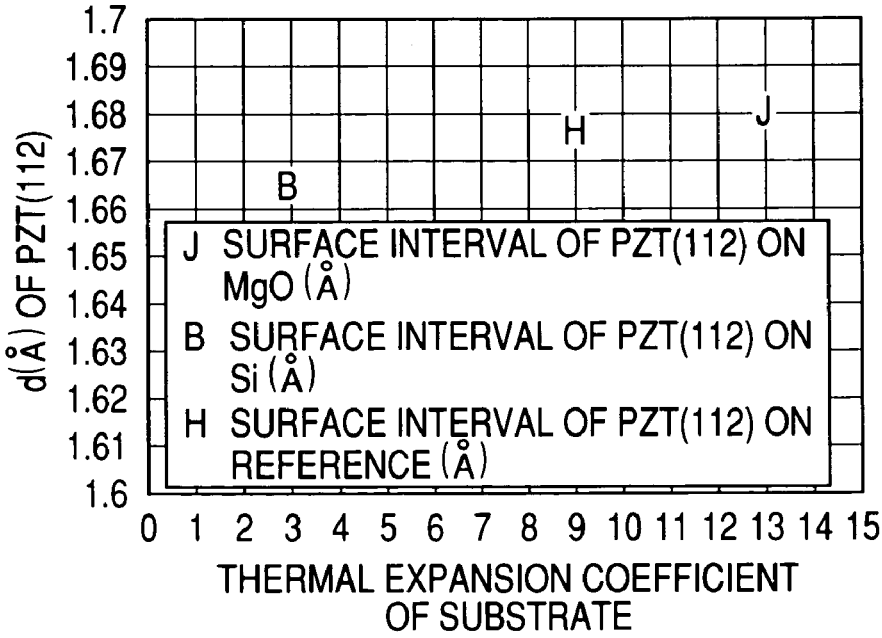
FIG. 8 is a graph for explaining a spacing of crystal planes of the PZT film.
Figure 9:
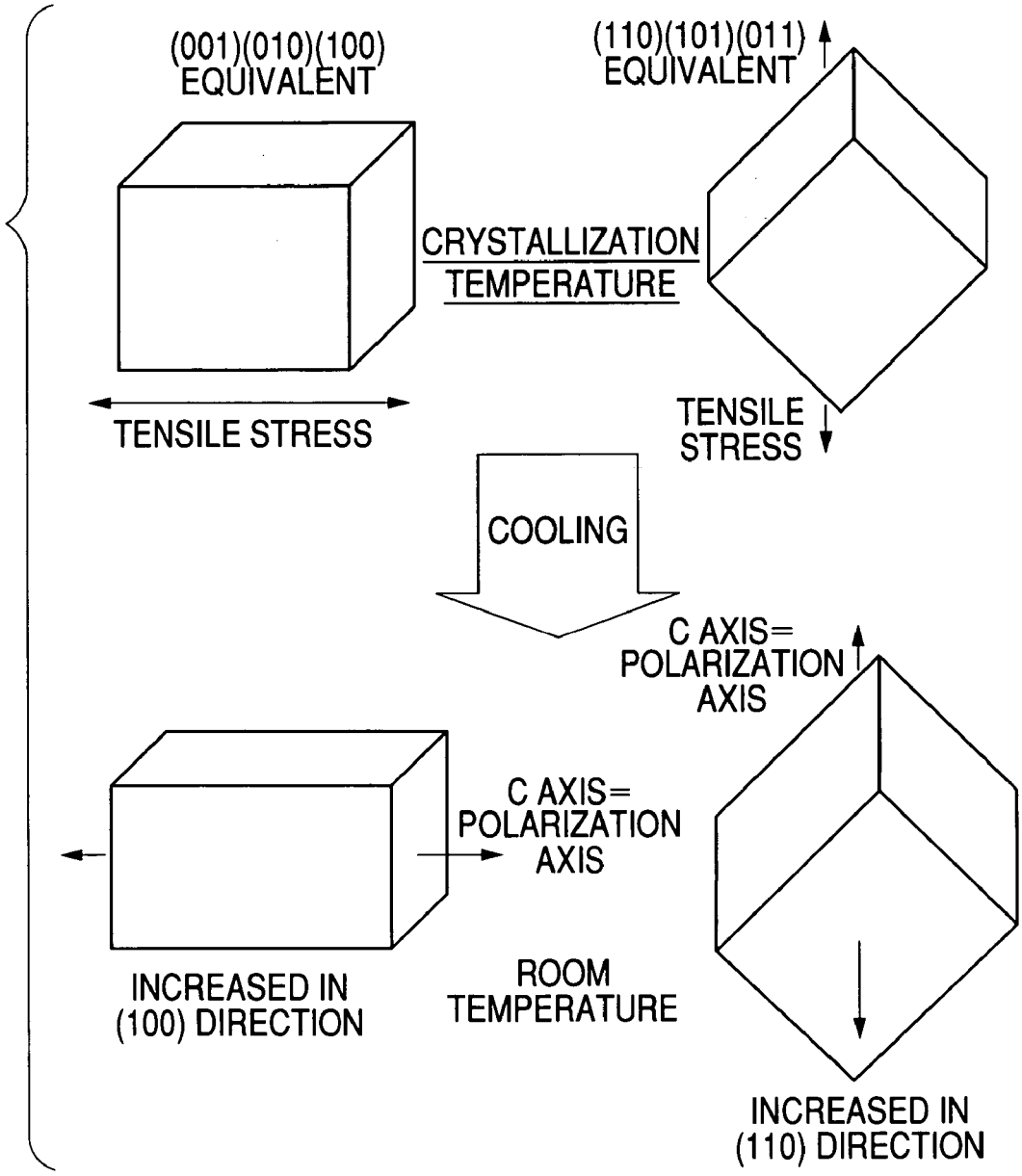
FIG. 9 is a view for explaining such a situation that 90 deg. domain becomes dominative by tensile stress.
Figure 10:
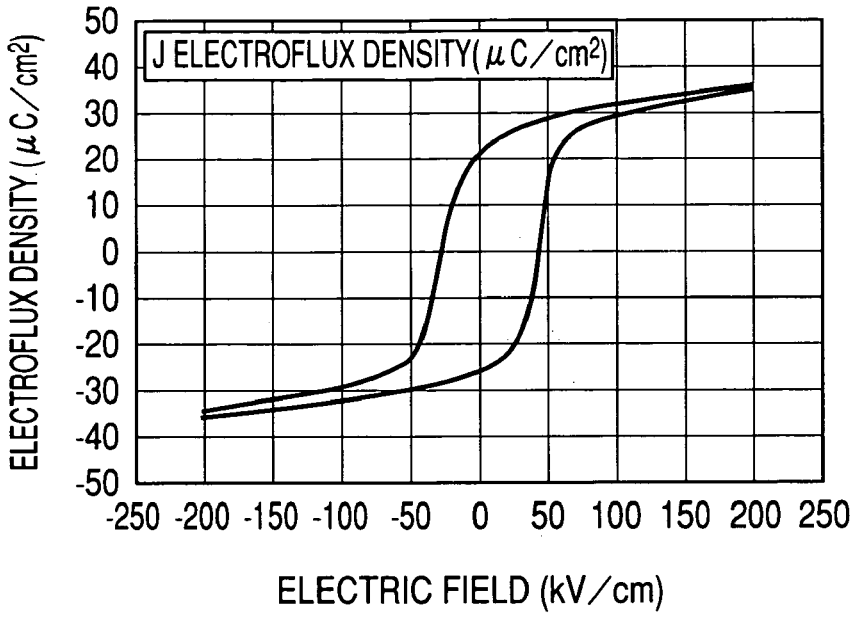
FIG. 10 is a graph which shows an electric characteristic of the PZT film in such a case that 90 deg. domain becomes dominative.
Figure 11:
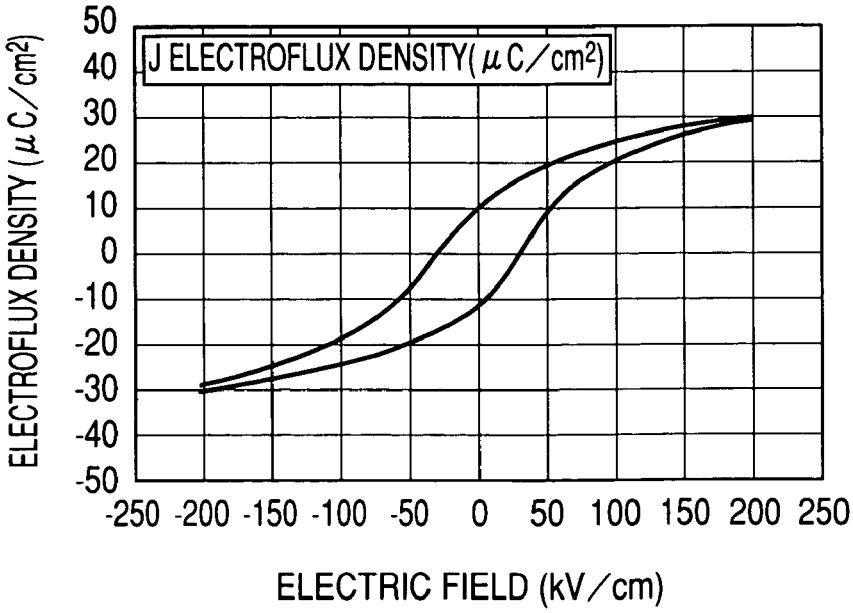
FIG. 11 is a graph which shows an electric characteristic of the PZT film in such a case that 90 deg. domain is restrained.

As a flow passage substrate 1 in the liquid discharge head shown in FIGS. 5A and 5B, an Si substrate formed therein grooves, as shown in FIGS. 6A and 6B, serving as a pressure chamber 2, nozzles 3, an orifice 4 and a liquid discharge chamber 5 was used, and was anodically joined thereto with aluminosilicate glass SD2 (Trade Mark belonging to HOYA co., Ltd) from which a diaphragm 6 is formed, then an MgO film having an extremely large thermal expansion coefficient was deposited thereon as an intermediate film by RF sputtering, and a PZT film serving as the piezoelectric film 8 was deposited thereon without heating, and was then sintered so as to obtain an unimorph type piezoelectric element.

At first, a groove or the like serving the pressure chamber was formed on an Si (100) substrate with the use of an anisotropic etching technology. The groove has a triangular prism-like shape, as viewed in the direction of the nozzle, as shown in FIG. 6B. Then, an aluminosilicate glass SD2 from which a glass diaphragm is formed, having a thickness of 30 μm was joined on the Si substrate through anodic joint, and the SD glass pane was polished so as to be thinned down to 5 m. The aluminosilicate glass SD2 has a thermal expansion coefficient of $3.2\times10^{-6}$ (/° C.) and a Young's modulus of $8.9\times10^{10}$ (N/m$^2$). The intermediate film 10 made of MgO having a large thermal expansion coefficient was deposited on the aluminosilicate glass which had been thinned by polishing, so as to have a thickness of 1 μm while it was heated by RF sputtering for crystallization. MgO has a thermal expansion coefficient of $13.0\times10^{-6}$ (/° C.) and a Young's modulus of $20.6\times10^{10}$ (N/m$^2$).

Ti having a thickness of 20 nm, as an adhesive layer, was formed thereon, and further, a Pt film having a thickness of 150 nm, which serves as a first electrode 9*a* was formed thereon by RF sputtering. Thereafter, an amorphous PZT film from which a piezoelectric film 8 is formed was formed thereon by a thickness of 1 μm at an exhibited Ar gas pressure of 3.0 PA with a substrate heater being turned off. This amorphous PZT film can be formed into a non-orientated PZT film by post heat-treatment at a temperature of 650° C. The PZT film has a thermal expansion coefficient of $9.0\times10^{-6}$ (/° C.) around the PPB composition and a Young's Modulus of $8.0\times10^{10}$ (N/m$^2$).

The thus formed PZT film was annealed for a five hours at a temperature of 650° C. with a rising and falling temperature of 1° C./min under the atmosphere of oxygen so as to be crystallized in order to form the piezoelectric film 8. Referring to FIG. 6B which shows the relationship of thermal contraction among the layers from the crystallization temperature to a room temperature, the thermal contraction of the diaphragm 6 is extremely small, and acts so as to cause tension, in comparison with the other layers. However, the intermediate film 10 having a large thermal expansion coefficient acts in the direction of compression so as to cancel out the tension. It is noted that the relationship of (Thermal Expansion Coefficient of Intermediate film MgO×Young's Modulus of the intermediate film×Thickness of the intermediate film)−(Thermal Expansion Coefficient of Diaphragm SD2×Young's Modulus of the Diaphragm SD2×Thickness of the Diaphragm SD2)≧(Thermal Expansion Coefficient of Piezoelectric Film PZT×Young's Modulus of the Piezoelectric Film PZT×Thickness of the Piezoelectric Film PZT) is satisfied while the relationship of (Thermal Expansion Coefficient of Intermediate film MgO)>(Expansion Coefficient of Piezoelectric Film PZT) is also satisfied, and accordingly, a compression force is applied to the PZT film serving as the piezoelectric film 8 in a temperature range from the crystallization temperature to a room temperature, and further, since the glass from which the diaphragm 6 is formed has a thin thickness of 3 μm so that the diaphragm 6 is deformed toward the pressure chamber 2 so that a compression force is not loosed, the domination of 90 deg. domain was restrained when the PZT film was cooled down from the sintering temperature to a room temperature. Further, the aluminosilicate glass SD2 has a strain point of 667° C., and no problem was raised even it was sintered at a temperature of 660° C.

Figure 12:
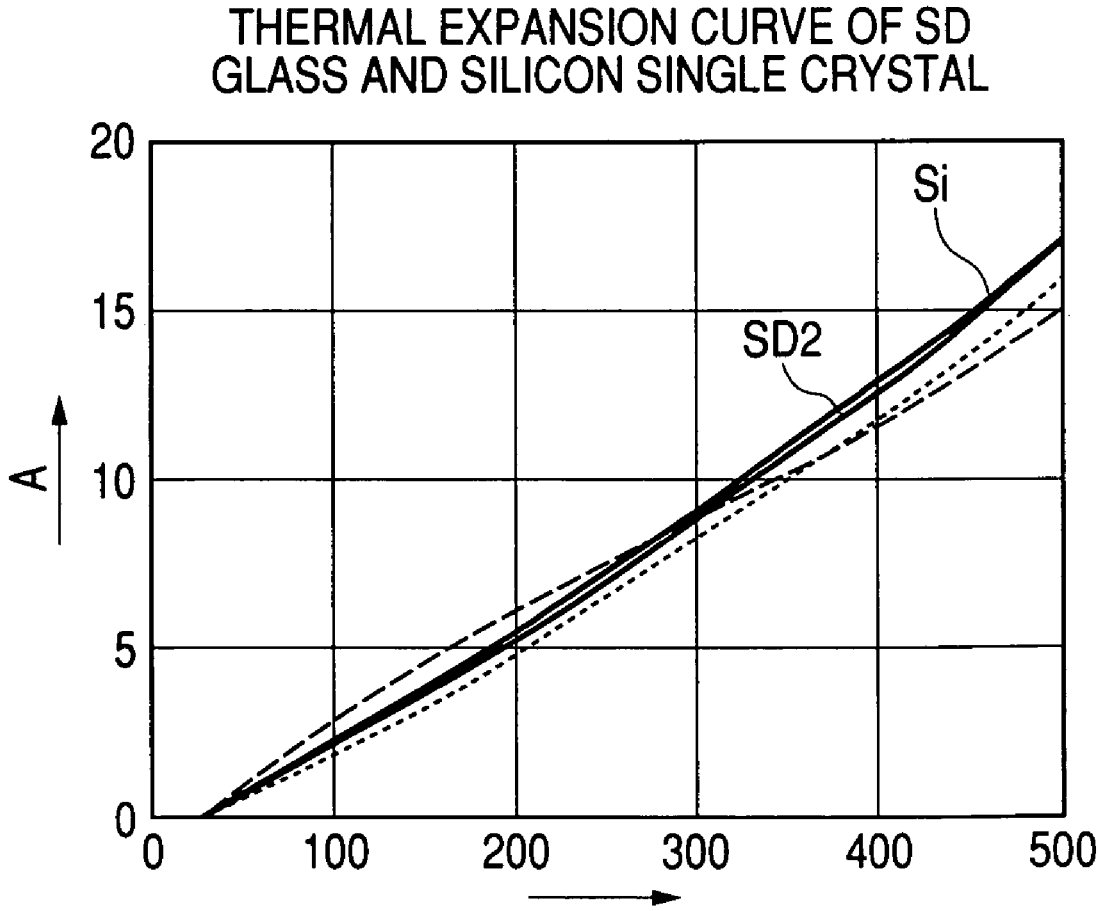
FIG. 12 is a graph for comparison between thermal expansion coefficients of SD glass and Si.

Referring to FIG. 12 which shows variation in the thermal expansion coefficients of the Si substrate and the aluminosilicate glass SD2 v.s. temperature (extracted from brochures issued by HOYA Co., Ltd), since the Si substrate and the aluminosilicate glass have thermal expansion coefficients which are nearly equal to each other up to a high temperature, and accordingly, no problem such as peel-off was raised even by sintering. Thereafter, a Pt film serving as a second electrode 9*b* was formed on the surface of the crystallized PZT film by RF sputtering.

By measuring the electric characteristic of the piezoelectric actuator, a satisfactory square ratio and a high saturated electric flux density were exhibited on a P-E curve which exhibits a relationship between a field strength and an electric flux density, and a satisfactory hysteresis was exhibited.

The Pt film on the PZT film was patterned by dry etching, being aligned with the grooves or the like of the Si substrate, and further, the PZT film was etched along the pattern on the Pt film by wet etching. The piezoelectric actuator having the thus manufactured unimorph type piezoelectric element was applied thereto with a rectangular wave as shown in FIG. 4 so as to be measured by a laser Doppler displacement meter. It could be confirmed that the piezoelectric actuator having a sufficient displacement can be obtained.

In this embodiment, since there is used the unimorph type piezoelectric element having the piezoelectric element having at its upper and lower surfaces the electrodes and applied at one surface thereof with the diaphragm, various devices using a unimorph piezoelectric element can be manufactured by variously processing the surface of the Si substrate.

After the liquid discharge head in this embodiment was filled therein with IPA, when the liquid discharge head was driven by a driving wave shown in FIG. 4, it was confirmed that liquid droplets are discharged.

Embodiment 4

In this embodiment, a liquid discharge head having a unimorph type piezoelectric element used as a piezoelectric actuator was formed, the unimorph type piezoelectric element being formed by depositing a PZT film serving as a piezoelectric film on an aluminosilicate glass SD2 which had been anodically joined on an Si substrate serving as a flow passage substrate, with the use of RF sputtering while it was crystallized by heating the substrate.

At first, a groove or the like serving the pressure chamber was formed on an Si (100) substrate with the use of an anisotropic etching technology. The groove has a triangular prism-like sectional shape. Then, an aluminosilicate glass SD2 from which a glass diaphragm is formed, having a thickness of 30 μm was joined on the Si substrate through anodic joint, and the aluminoslicate glass SDs was polished so as to be thinned down to 5 μm. The aluminosilicate glass SD2 has a thermal expansion coefficient of $3.2\times10^{-6}$ (/° C.) and a Young's modulus of $8.9\times10^{10}$ (N/m$^2$). An MgO film having a large thermal expansion coefficient was deposited on the aluminosilicate glass which had been thinned by polishing, so as to have a thickness of 1.5 μm while it was heated by RF sputtering for crystallization. MgO has a thermal expansion coefficient of $13.0\times10^{-6}$ (/° C.) and a Young's modulus of $20.6\times10^{10}$ (N/m$^2$). Ti having a thickness of 20 nm, as an adhesive layer, was formed thereon, and further, a Pt film having a thickness of 150 nm, which serves as a first electrode was formed thereon by RF sputtering.

A PZT film was deposited thereon at a substrate temperature of 650° C. and at an exhibited Ar gas pressure of 0.3 Pa while it was crystallized. The PZT has a thermal expansion coefficient of $9.0\times10^{-6}$ (/° C.) around the MPB composition and a Young's modules of $8.0\times10^{10}$. Since it has such a relationship as (Thermal Expansion Coefficient of MgO×Young's Modulus×Thickness)−(Thermal Expansion Coefficient of Diaphragm×Young's Modulus×Thickness)≧(Thermal Expansion Coefficient of PZT×Young's Modulus×

Thickness) is satisfied, and since the relationship of (Thermal Expansion Coefficient of MgO)>(Expansion Coefficient of Film PZT) is also satisfied, a compression force is applied to the PZT film in a temperature range from the crystallization temperature to a room temperature, and further, since the glass from which the diaphragm 6 is formed has a thin thickness of 5 μm so that the diaphragm 6 is deformed toward the pressure chamber 2, resulting in that a compression force is not lost, the domination of 90 deg. domain was restrained when the PZT film was cooled down from the sintering temperature to a room temperature. Further, as shown in FIG. 12, since the Si substrate and the aluminosilicate glass have thermal expansion coefficients which are nearly equal to each other up to a high temperature, no peel-off was absolutely raised even though the substrate temperature was raised up to, held at and lowered from a temperature of 650° C. A Pt film serving as a second electrode was formed on the surface of the crystallized PZT film by RF sputtering.

By measuring the electric characteristic of the piezoelectric actuator, a satisfactory square ratio and a high saturated electric flux density were exhibited on a P-E curve which exhibits a relationship between a field strength and an electric flux density, and a satisfactory hysteresis was exhibited.

Then, the Pt film on the PZT film was patterned by dry etching, being aligned with the grooves or the like of the Si substrate, and further, the PZT film was etched along the pattern on the Pt film by wet etching. The thus manufactured unimorph type piezoelectric element was applied thereto with a rectangular wave as shown in FIG. 4 so as to be measured by a laser Doppler displacement meter. It could be confirmed that the piezoelectric actuator having a sufficient displacement can be obtained.

After the liquid discharge head in this embodiment was filled therein with IPA, when the liquid discharge head was driven by a driving wave shown in FIG. 4, it was confirmed that liquid droplets are discharged.

This application claims priority from Japanese Patent Application Nos. 2003-383272 filed on Nov. 13, 2003 and 2003-403921 filed on Dec. 3, 2003, which are hereby incorporated by reference herein.

What is claimed is:

1. A method of manufacturing a liquid discharge head in which liquid in a pressure generation chamber is pressurized by a piezoelectric driving force of a piezoelectric element, and is discharged from a nozzle communicating with the pressure generating chamber, comprising the steps of:

providing a flow passage substrate incorporating the pressure generation chamber;

anodically joining a diaphragm to the flow passage substrate;

providing an intermediate film on the diaphragm;

forming electrode layers and a piezoelectric film of the piezoelectric element on the intermediate film; and crystallizing the piezoelectric film during or after the forming step at a temperature lower than a transition point of the diaphragm;

wherein the joining step, the step of providing the intermediate film and the forming step are performed to satisfy a relationship where (thermal expansion coefficient of the intermediate film×Young's Modulus of the intermediate film×thickness of the intermediate film)−(thermal expansion coefficient of the diaphragm×Young's Modulus of the diaphragm×thickness of the diaphragm)≧(thermal expansion coefficient of the piezoelectric film×Young's Modulus of the piezoelectric film×thickness of the piezoelectric film).

2. A method of manufacturing a liquid discharge head according to claim 1, wherein in the crystallizing step, the piezoelectric film is crystallized at a temperature not higher than a strain point of the diaphragm.

3. A method of manufacturing a liquid discharge head according to claim 1, further comprising a step of thinning the diaphragm by polishing down to a thickness of not greater than 10 μm after the joining step and before the forming step.

4. A method of manufacturing a liquid discharge head according to claim 1, wherein the piezoelectric film of the piezoelectric element is an oxide deposited under vacuum and having a perovskite structure containing at least Pb.

5. A method of manufacturing a liquid discharge head according to claim 1, wherein the diaphragm is made of glass including Na.

6. A method of manufacturing a liquid discharge head according to claim 5, wherein the glass is borosilicate glass, aluminosilicate glass or aluminoborosilicate glass.

7. A method of manufacturing a liquid discharge head according to claim 6, wherein the intermediate film is an MgO film, a $ZrO_2$ film or a Cu film.

8. A method of manufacturing a liquid discharge head according to claim 1, wherein the flow passage substrate comprises silicon.

9. A method of manufacturing a liquid discharge head according to claim 1, further comprising a step of forming an intermediate film on the diaphragm between the joining step and the forming step.

* * * * *

UNITED STATES PATENT AND TRADEMARK OFFICE

CERTIFICATE OF CORRECTION

PATENT NO. : 7,380,318 B2
APPLICATION NO. : 10/985928
DATED : June 3, 2008
INVENTOR(S) : Wada et al.

It is certified that error appears in the above-identified patent and that said Letters Patent is hereby corrected as shown below:

COLUMN 3:
Line 9, “thigh temperature” should read --high temperature--.
Line 54, “crystalline” should read --crystalline axis--.

COLUMN 4:
Line 27, “cannot not” should read --cannot be--.
Line 45, “diaphragm, thereby” should read --diaphragm. Thereby--.
Line 46, “peel-of” should read --peel off--.

COLUMN 5:
Line 62, “like, thereby” should read --like. Thereby--.

COLUMN 6:
Line 37, “$SiO^2$” should read --$SiO_2$--.
Line 62, “PTZ film” should read --PZT film--.

COLUMN 7:
Line 2, “PTZ” should read --PZT--.
Line 14, “PTZ,” should read --PZT,--.

COLUMN 8:
Line 21, “v.s. temperature” should read --vs. temperature--.

COLUMN 11:
Line 34, “aliminosilicate” should read --aluminosilicate--.

COLUMN 12:
Line 42, “150d°C.” should read --150°C.--.

COLUMN 14:
Line 11, “a thermal” should read --thermal--.
Line 28, “is desirable” should read --are desirable.--.
Line 58, “co., Ltd)” should read --Co., Ltd)--.

UNITED STATES PATENT AND TRADEMARK OFFICE

CERTIFICATE OF CORRECTION

PATENT NO. : 7,380,318 B2
APPLICATION NO. : 10/985928
DATED : June 3, 2008
INVENTOR(S) : Wada et al.

It is certified that error appears in the above-identified patent and that said Letters Patent is hereby corrected as shown below:

COLUMN 15:
Line 5, "5 m." should read --5 μm.--.
Line 39, "of the intermediate film" should be deleted.
Line 40, "of the intermediate film" should be deleted.
Line 41, "of the diaphragm SD2" should be deleted.
Line 42, "of the diaphragm SD2" should be deleted.
Line 43, "Modulus of" should read --Modulus--.
Line 44, "the Piezoelectric film PZT" should be deleted, and "of the Piezoelectric" should be deleted.
Line 45, "Film PZT" should be deleted.
Line 63, "v.s. temperature" should read --vs. temperature--.

COLUMN 16:
Line 20, "having the piezoelectric element" should be deleted.
Line 46, "glass SDs" should read --glass SD2--.
Line 63, "modules" should read --modulus--.

Signed and Sealed this

Seventeenth Day of March, 2009

JOHN DOLL
*Acting Director of the United States Patent and Trademark Office*